United States Patent [19]

Nettesheim et al.

[11] Patent Number: 4,492,162

[45] Date of Patent: Jan. 8, 1985

[54] TYPE BAND INK STAMP

[75] Inventors: Daniel R. Nettesheim, Waukesha; Fred W. Kufrin, Jamesville, both of Wis.

[73] Assignee: Schwaab Inc., Milwaukee, Wis.

[21] Appl. No.: 476,054

[22] Filed: Mar. 17, 1983

[51] Int. Cl.[3] ..... B41J 1/20

[52] U.S. Cl. ..... 101/103; 101/111; 101/405

[58] Field of Search ..... 101/105, 111, 405, 406, 101/100, 373, 110, 103, 334, 104

[56] References Cited

U.S. PATENT DOCUMENTS

| | | | |
|---|---|---|---|
| 435,159 | 8/1890 | Smith | 101/111 |
| 1,247,014 | 11/1917 | Rogers | 101/111 |
| 2,088,009 | 7/1937 | Melind | 101/111 |
| 2,966,116 | 12/1960 | Harris et al. | 101/405 X |
| 3,661,078 | 5/1972 | Hammel | 101/405 X |
| 3,719,140 | 3/1973 | Hammel | 101/405 X |

FOREIGN PATENT DOCUMENTS

| | | | |
|---|---|---|---|
| 963479 | 5/1957 | Fed. Rep. of Germany | 101/111 |

*Primary Examiner*—Edgar S. Burr
*Assistant Examiner*—Charles A. Pearson
*Attorney, Agent, or Firm*—Andrus, Sceales, Starke & Sawall

[57] ABSTRACT

An ink stamp having movable type bands. The stamp includes an outer housing having a die plate located at its lower end and carrying an ink impregnated stamp. A frame is mounted for vertical movement within the housing and carries a series of endless type bands with each band having a plurality of spaced type characters with the lowermost character in each band adapted to project through an opening in the die plate. An upper handle or knob is connected to the frame and by pulling upwardly on the handle, the frame and bands can be raised above the die plate to a position where the bands can be rotated to change the lowermost type characters, as desired. The stamp also has a provision to adjust the heights of the type bands relative to the outer housing to insure that the lowermost operating type character is at a level flush with the lower surface of the stamp in the die plate.

16 Claims, 9 Drawing Figures

FIG.1
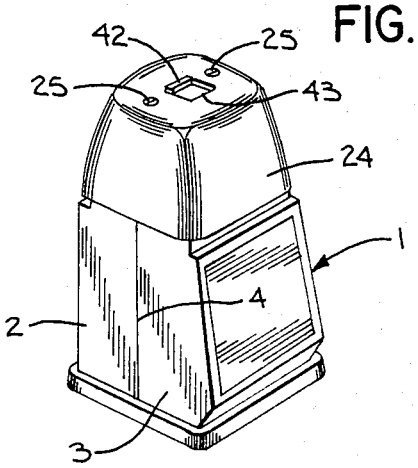
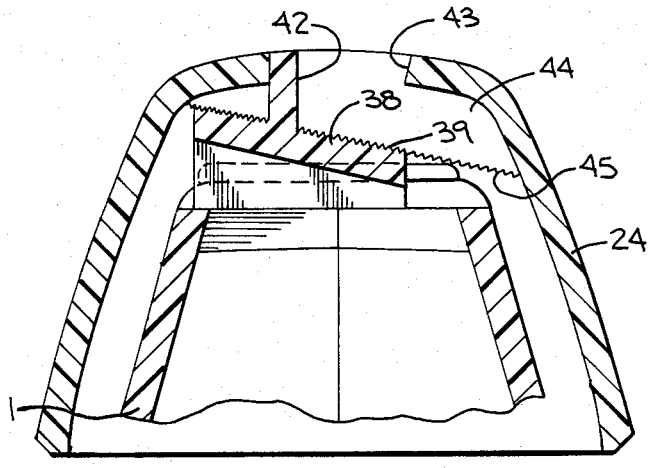
FIG.4
FIG.2
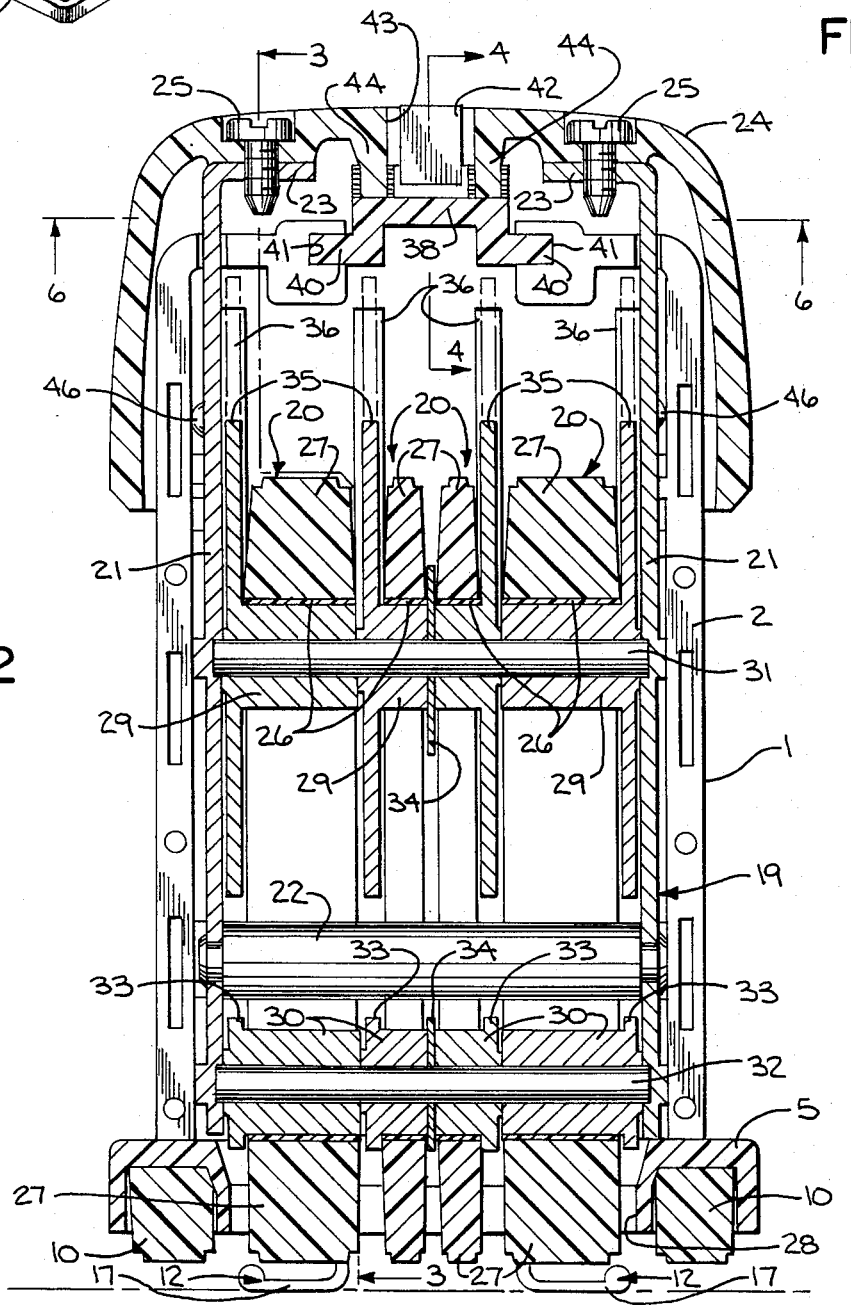

FIG. 3
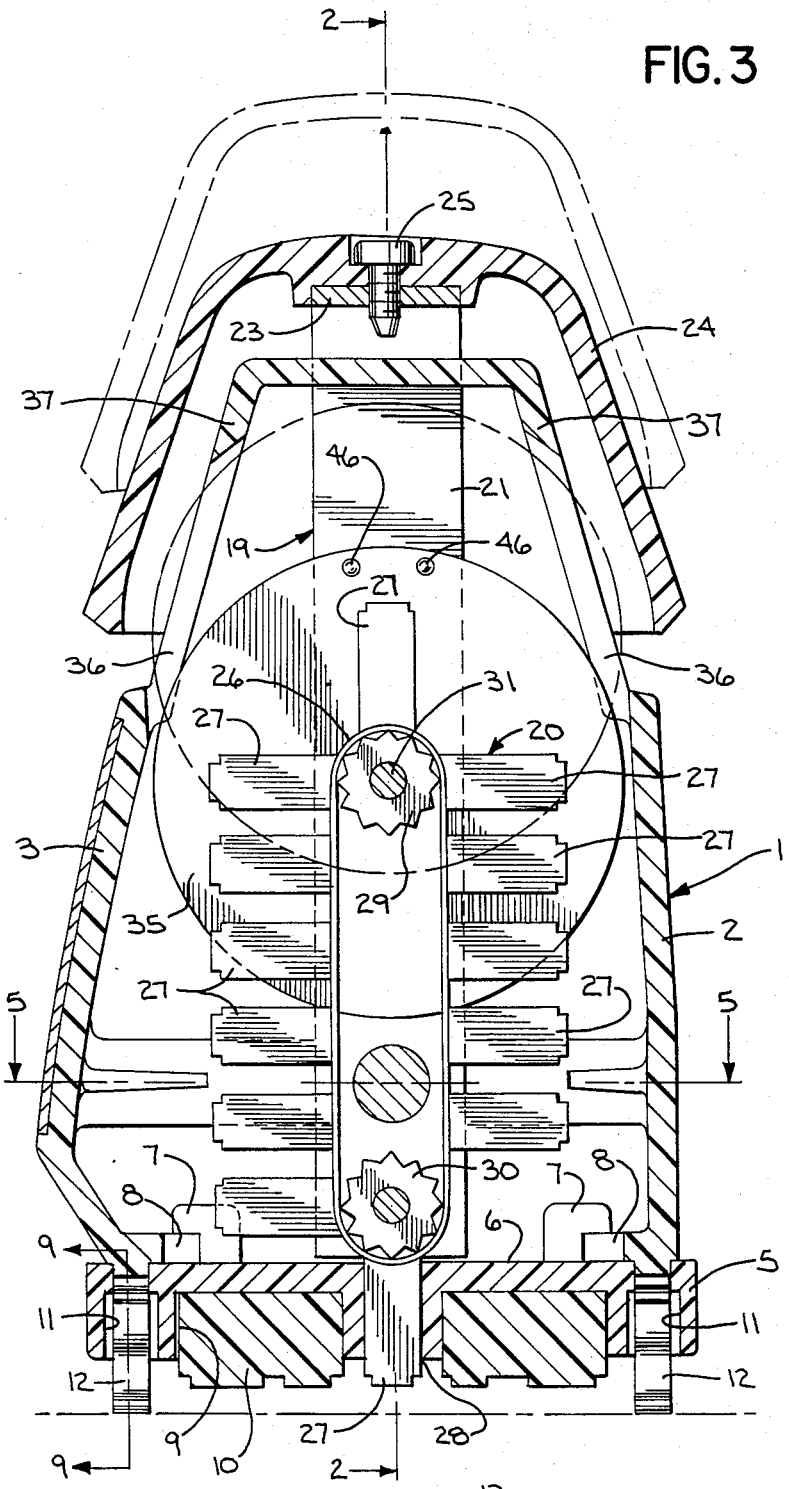
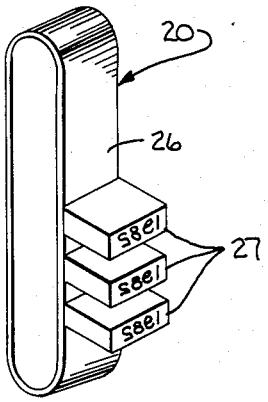
FIG. 8
FIG. 9
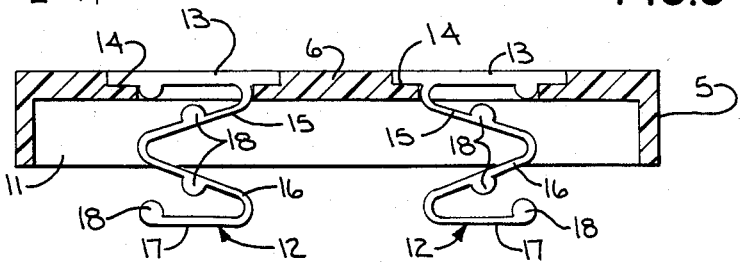

TYPE BAND INK STAMP

BACKGROUND OF THE INVENTION

Conventional date stamps or time stamps include a series of movable endless type bands, each carrying a number of different type characters. For example, the conventional date stamp may include four separate type bands with the type characters of one band carrying the various months of the year, the type characters of two other belts carrying numerals for the days of the month, and the type characters of the fourth belt carrying the years.

In the typical date or time stamp, the lowermost type character in each band is adapted to project through an opening in a hinged die plate which carries a fixed ink stamp bearing the name of the company or other information. To change the date, the die plate is unhinged and the bands can then be individually moved with a finger or an implement, such as a pencil, to position the proper type character at the lowermost position. The die plate is then closed causing the lowermost type character of each band to be extended through the opening to a position generally flush with the lower surface of the fixed ink stamp on the die plate.

The conventional date and time stamps as used in the past have been unattractive in appearance and the changing of the type characters on the bands was an awkward operation. Furthermore, the conventional type band stamps had no provision for adjusting the relative position of the fixed ink stamp and the type characters on the bands to compensate for wear during service.

SUMMARY OF THE INVENTION

The invention is directed to an improved type band ink stamp. In accordance with the invention, the ink stamp includes an outer housing, and a die plate is located at the lower end of the housing and supports a fixed ink stamp. Mounted for sliding vertical movement within the housing is a frame that carries a plurality of endless type bands, each band having a series of spaced type characters with the lowermost character on each band adapted to project through an opening in the die plate when the stamp is in the operating condition.

Connected to the upper end of the frame is a knob or handle and by pulling upwardly on the handle the frame and type bands can be raised to a position where the bands can be rotated to change the lowermost type character. Rotation of the type bands is accomplished by adjusting wheels which are operably connected to each band, and in the upper adjusting position of the frame, the wheels project through slots in the housing where they can be operated by the user. When the frame is in the lower operating position, the adjusting wheels are located within the confines of the housing so that they cannot be rotated by the operator. This insures that the type bands will not be accidentally rotated while the bands are in the operative position and eliminates the possibility of the lowermost type character being ripped from the band.

The ink stamp of the invention also has a provision to adjust the height of the frame and type bands relative to the outer housing to insure that the lowermost type character is at a level flush with the outer surface of the fixed ink stamp on the die plate.

As an additional feature, a series of springs project downwardly from the die plate and serve to support the stamp in a storage position. In this condition, the springs will space the fixed ink stamp and type characters of the bands above the supporting surface. In use, the operator pushes downwardly on the handle compressing the springs and bringing the fixed ink stamp, as well as the type characters of the bands, into contact with the paper or other surface on which an impression is to be made.

The ink stamp of the invention utilizes microporous type characters which are preimpregnated with ink, thereby eliminating the need of an ink pad. As the type characters and the fixed die stamp are preimpregnated with ink, different ink colors can be employed, if desired, for the die stamp and type characters.

While the invention has particular application to a date stamp or time stamp, it can be used in any application where a changeable impression is desired.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the ink stamp of the invention;

FIG. 2 is a vertical section of the ink stamp;

FIG. 3 is a section taken along line 3—3 of FIG. 2;

FIG. 4 is a section taken along line 4—4 of FIG. 2;

FIG. 8 is a perspective view of one of the type bands; and

FIG. 9 is a section taken along line 9—9 of FIG. 3 and showing the spring supporting mechanism.

DESCRIPTION OF THE ILLUSTRATED EMBODIMENT

Figure 5:
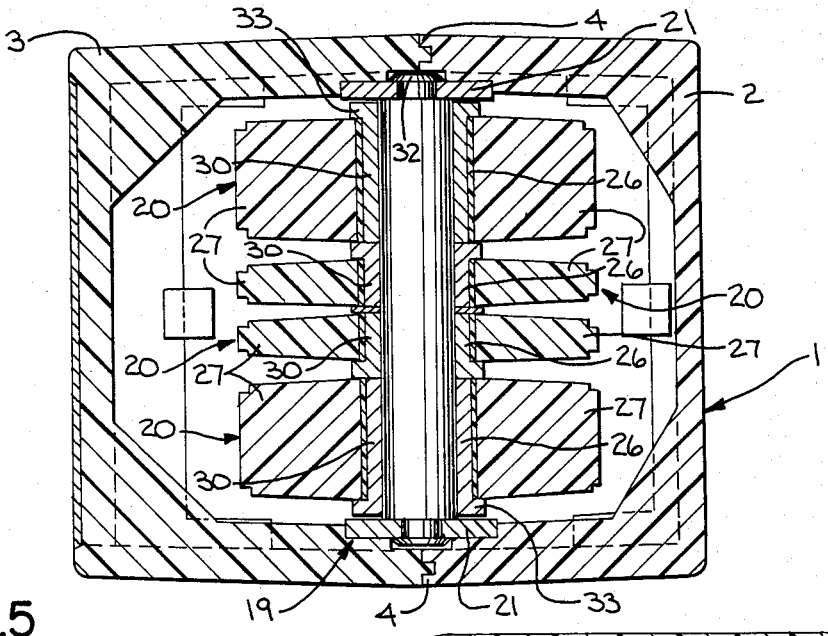
FIG. 5 is a section taken along line 5—5 of FIG. 3.

The ink stamp of the invention includes an outer housing 1 composed of a pair of sections 2 and 3 which are joined together by dovetail joints 4.

Secured within the open lower end of housing 1 is a die plate 5, and the base 6 of die plate 5 is formed with a series of upstanding generally L-shaped hooks 7, as shown in FIG. 3, which engage shoulders 8 formed on the respective sections 2 and 3 to secure the die plate in the housing.

Die plate 5 is formed with a recess 9 which contains a fixed ink stamp 10, and the corners of the die plate define a series of compartments 11 that receive springs 12. As best shown in FIG. 9, each spring 12 includes a base section 13 which is mounted within a recess 14 in the upper surface of base 6, and a diagonal section 15 extends outwardly from section 13 through an opening in the base. The outer end of spring section 15 is connected to spring section 16, which, in turn, is connected to spring section 17. As shown in FIG. 9, section 17 is disposed generally parallel to base portion 13 and is adapted to rest on the supporting surface and space die plate 5 above the surface. Nibs or projections 18 are formed on spring sections 15, 16 and 17 and prevent overcompression of the spring when the stamp is pushed downwardly against the supporting surface.

Mounted within housing 1 is a frame 19 which supports a plurality of type bands 20. Frame 19 includes a pair of spaced side members 21 and the lower ends of side members 21 are connected together by rod 22, while the upper ends of the side members extend through slots formed in the upper ends of housing sections 2 and 3, respectively, and terminate in flanges 23. The flanges 23, in turn, are secured to a handle or knob 24 by screws 25. As shown in FIGS. 2 and 3, the handle 24 extends downwardly and encloses the upper end of the housing 1.

The ink stamp, as illustrated in the drawings, is to be used as a date stamp and in this application contains four type bands 20. Each type band includes an endless band 26, composed of plastic or fabric material, and type characters 27 are vulcanized or otherwise secured to the outer surface of each band. Type characters 27 are formed of a microporous polymeric material and are preimpregnated with printing ink. As best illustrated in FIG. 3, the type characters 27 of each band are spaced apart and when the type band is in the operable position, the lowermost type character of each band projects through an opening or slot 28 in the die plate 5, as shown in FIG. 3.

As a date stamp, one group of type characters 27 would bear the various months of the year, two other groups of type characters 27 would each bear numerals designating the date of the month, while the fourth group of type characters would bear the years.

The endless bands 26 are each supported on hubs 29 and 30. Hubs 29 are mounted on shaft 31, the ends of which are connected to the frame members 21, while lower hubs 30 are mounted on a shaft 32, which is also connected between the frame side members 21.

To facilitate individual movement of the type bands 26, each lower hub 30 is provided with a shoulder 33 which engages the adjacent hub and reduces the frictional resistance between adjacent hubs. In addition, a spacer disc 34 is located between the central hubs 29 and 30.

To individually move or rotate each type band 26, an adjusting wheel 35 is associated with each of the upper hubs 29. The adjusting wheels 35 have knurled or serrated outer surfaces and the periphery of each wheel is adapted to project outwardly through opposed slots 36 formed in the housing sections 2 and 3 when the frame 19 and type bands 26 are in an upper adjusting position, as will be hereinafter described.

In the operative position, one of the type characters 27 of each type band 26 will project downwardly through the opening 28 in die plate 5 and the lower extremity of each type character will be substantially flush with the lower surface of the stamp 10. As previously noted, the spring feet 12 will support the stamp above the supporting surface. To make an ink impression on paper or other surface, the stamp is pushed downwardly by the operator by applying pressure to the upper end of the handle 24, thereby compressing the springs 12 and bringing the stamp 10 and type characters 27 into contact with the surface.

When it is desired to change the type characters, the handle 24 is pulled upwardly, thereby drawing the frame 19 and type bands 26 upwardly (phantom lines in FIG. 3) to a position where the lowermost type characters 27 are above the base 6 of die plate 5. As the side walls 37 of housing 1 converge upwardly, the periphery of the setting wheels 35 will extend outwardly through slots 36 when the frame 19 and type bands 26 are in the upper or adjusting position. The operator, using a thumb and forefinger, can then rotate the setting wheels 35 to rotate the type bands 26 and move the desired type character 27 into alignment with the opening 28 in the die plate 5. By pushing downwardly on the handle, the frame 19 and type bands 26 will be moved downwardly causing the lowermost type characters 27 to be extended into the slot 28 to the operative position.

The ink stamp of the invention also includes a provision for adjusting the position of frame 19 and type bands 26 relative to housing 1 to insure that the lower surfaces of the protruding type characters 27 are at a level flush with the lower surface of the ink stamp 10. The adjusting mechanism includes a wedge block 38 which is supported by the upper end of the housing 1 and is located beneath handle 24. Wedge block 38 is provided with an upper serrated inclined surface 39. Wedge block 38 is adapted to be moved laterally relative to housing 1 and to accommodate this sliding movement the wedge block is provided with a pair of laterally extending guide legs 40 which are mounted for sliding movement within guideways 41 formed in the housing sections 2 and 3, as shown in FIG. 2. A tab 42 extends upwardly from wedge block 38 through an opening 43 formed in the handle 24.

Figure 6:
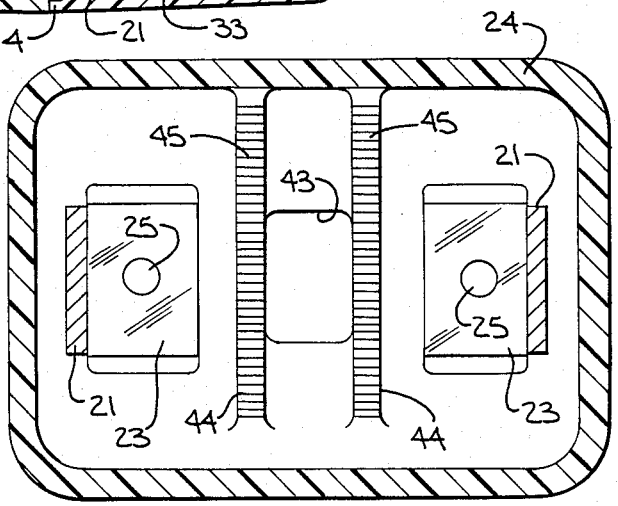
FIG. 6 is a section taken along line 6—6 of FIG. 2.
Figure 7:
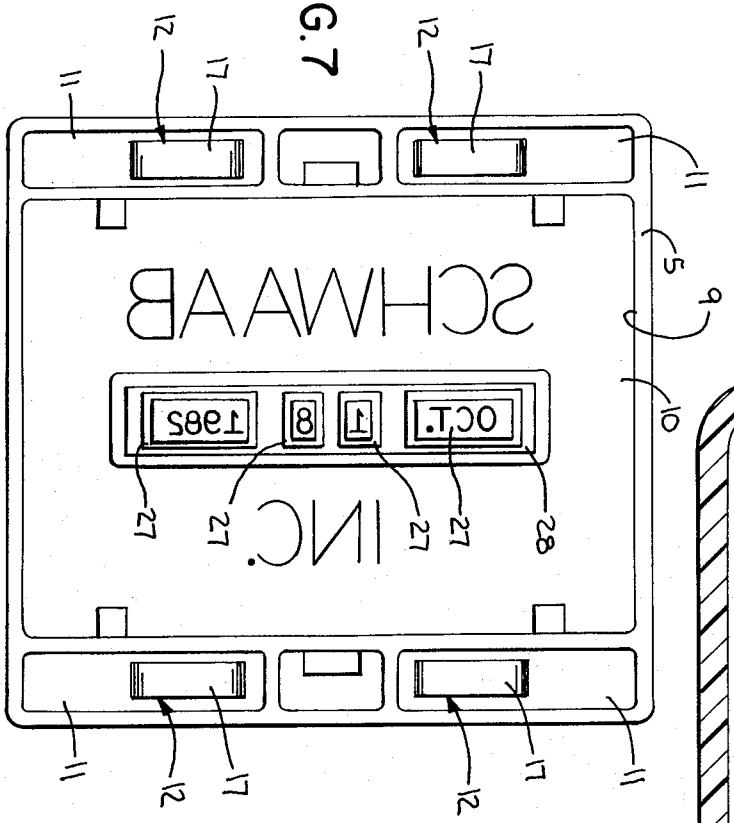
FIG. 7 is a bottom view of the ink stamp.

As best shown in FIGS. 2 and 6, a pair of parallel walls 44 depend from the inner surface of the handle and terminate in inclined serrated surfaces 45 which mate with the inclined surfaces 39 on the wedge block. Thus, the operator by grasping the tab 42 can move the wedge-block in the guideways 41 and the wedging action of surface 39 operating against surface 45 will correspondingly raise and lower the handle to correspondingly adjust the position of the type characters 27 located within opening 28 with respect to stamp 10. This adjustment insures that the lower extremities of the type characters 27 that project through openings 28 will be in the same horizontal plane as the lower surface of stamp 10, thereby providing a uniform ink impression on the paper.

A pair of friction pads 46 are formed on the outer surface of each side member 21 and the pads ride against the side walls of outer housing 1. Pads 46 increase the frictional resistance between the members to keep the handle from pulling away from the housing when the stamp is elevated.

While the drawings have shown the stamp of the invention used as a date stamp, it is contemplated that the invention can be used for a time stamp or any other type of stamp requiring a changeable impression. Furthermore, the movable type bands can be used without the fixed stamp 10, if desired.

Various modes of carrying out the invention are contemplated as being within the scope of the following claims particularly pointing out and distinctly claiming the subject matter which is regarded as the invention.

We claim:

1. An improved type band ink stamp, comprising a housing having an opening in the lower end, a frame disposed within the housing, means for mounting the frame for vertical movement relative to the housing between a lower operating position and an upper adjusting position, an endless type band carried by the frame and having a plurality of type characters spaced along the length of said band, a handle operably connected to the frame whereby lowering and raising of the handle will move the frame between the operating and adjusting positions, the lowermost type character of said band projecting through said opening in said housing when the frame is in the lower operating position and said lowermost type character being disposed above said opening when said frame is in the upper adjusting position, and adjusting means including a manually adjusting member disposed in the housing for adjusting the band when the frame is in the adjusting position whereby the desired type character can be moved into alignment with said opening in the housing, said adjusting member extending through an aperture in said housing to an accessible position when the frame is in the upper adjusting position and said adjusting member being located within the housing in an inaccessible position when said frame is in the lower operating position.

2. The stamp of claim 1, and including a pair of vertically spaced rotatable supports carried by the frame, said endless type band being mounted for movement on said supports, said adjusting member operably connected to one of said supports.

3. The stamp of claim 2, wherein said housing is provided with an inclined side wall, said aperture disposed in said inclined side wall, said adjusting member being associated with the upper of said spaced supports and arranged to project outwardly through said aperture when the frame is in the upper adjusting position, whereby said adjusting member is accessible for adjustment.

4. The stamp of claim 1, and including a fixed ink stamp mounted on the lower end of said housing, said opening being adjacent said fixed ink stamp.

5. The ink stamp of claim 1, wherein said type characters are formed of a resilient microporous material and are preimpregnated with ink.

6. The ink stamp of claim 4, and including adjusting means for adjusting the operative position of the frame relative to the housing whereby the lower extremity of the lowermost type character projecting through said opening can be maintained substantially flush with the lower surface of said ink stamp.

7. The ink stamp of claim 6, wherein said adjusting means includes a movable wedge interconnecting the frame and said housing, movement of said wedge resulting in relative movement between the frame and the housing.

8. The ink stamp of claim 7, and including a manually engageable member connected to said wedge and extending through an opening in the handle.

9. The ink stamp of claim 8 and including locking means for locking the wedge in a given position.

10. An improved type band ink stamp, comprising an outer housing having a pair of opposed upwardly converging side walls, a fixed ink stamp mounted on the lower surface of the housing, said lower surface having an opening therein adjacent said ink stamp, a frame disposed within the housing and mounted for relative vertical movement relative to the housing between an upper adjusting position and a lower operating position, a pair of vertically spaced support members carried by the frame, at least one endless type band mounted for movement on said support members, said type band including a plurality of type characters, the lowermost type character of said band projecting through said opening when said frame is in the lower operating position and the lowermost type character of said band being located above said opening when the frame is in the upper adjusting position, a handle enclosing the upper end of the housing and operably connected to the frame whereby lowering and raising of the handle will move the frame between the upper and lower positions, said handle including a downwardly extending skirt surrounding the side walls of said housing, an adjusting member disposed within the housing operably connected to each type band, at least one of said side walls of said housing having a slot therein, said adjusting member being disposed within the slot when the frame is in the upper adjusting position whereby the adjusting member projects outwardly of said housing to a manually accessible location and the type band can be rotated by movement of said adjusting member, said adjusting member being disposed inwardly of said slot in an inaccessible location within the housing when the frame is in the lower operating position.

11. The stamp of claim 10, and including adjusting means operably connected between the frame and the housing for adjusting the operating position of the frame whereby the lower extremity of the lowermost type character can be maintained relatively flush with the lower surface of said ink stamp.

12. The ink stamp of claim 10, and including a plurality of said type bands with each type band being mounted on said support members, and a plurality of said adjusting members each operably connected to a band and receivable within a slot in said housing when the frame is in the upper position.

13. The ink stamp of claim 10, where the adjusting member is a wheel disposed in a vertical plane and operably connected to the upper of said support members.

14. The ink stamp of claim 10, and including resilient means extending downwardly from said housing to a level beneath said fixed ink stamp and disposed to support the stamp above a surface, downward force on said handle causing compression of said resilient means to enable said fixed ink stamp and said lowermost type character to contact said surface.

15. The ink stamp of claim 14, wherein said resilient means comprises a plurality of springs, each having a zig-zag shape and terminating in a lower generally flat supporting section disposed to engage the surface to be printed.

16. The ink stamp of claim 10, wherein said downwardly extending skirt substantially encloses said slot when the frame is in the lower position and said skirt being in a non-obstructing position with respect to the slot when the frame is in its upper position.

* * * * *